US010583966B2

(12) United States Patent
Sloan

(10) Patent No.: US 10,583,966 B2
(45) Date of Patent: Mar. 10, 2020

(54) LID FOR A BEVERAGE CONTAINER

(71) Applicant: Craig Sloan, Livingston (GB)

(72) Inventor: Craig Sloan, Livingston (GB)

( * ) Notice: Subject to any disclaimer, the term of this patent is extended or adjusted under 35 U.S.C. 154(b) by 10 days.

(21) Appl. No.: 15/761,998

(22) PCT Filed: Sep. 20, 2016

(86) PCT No.: PCT/GB2016/052925

§ 371 (c)(1),
(2) Date: Mar. 21, 2018

(87) PCT Pub. No.: WO2017/051162

PCT Pub. Date: Mar. 30, 2017

(65) Prior Publication Data

US 2018/0257824 A1 Sep. 13, 2018

(30) Foreign Application Priority Data

Sep. 22, 2015 (GB) ..... 1516783.6

(51) Int. Cl.
*B65D 43/02* (2006.01)

(52) U.S. Cl.
CPC ..... *B65D 43/0212* (2013.01); *B65D 2543/00046* (2013.01); *B65D 2543/00092* (2013.01); *B65D 2543/00296* (2013.01); *B65D 2543/00527* (2013.01); *B65D 2543/00537* (2013.01); *B65D 2543/00731* (2013.01); *B65D 2543/00796* (2013.01)

(58) Field of Classification Search
CPC ..... B65D 43/0212; B65D 47/06; B65D 2205/02; B65D 2231/025; B65D 2543/00046
See application file for complete search history.

(56) References Cited

U.S. PATENT DOCUMENTS

| | | | | |
|---|---|---|---|---|
| 6,523,712 | B1 | 2/2003 | McGushion | |
| 6,991,128 | B1 | 1/2006 | Russo et al. | |
| 2002/0038803 | A1* | 4/2002 | Malcolm | B65D 47/06 220/713 |
| 2010/0133272 | A1* | 6/2010 | Whitaker | B65D 43/0212 220/254.1 |
| 2014/0299614 | A1 | 10/2014 | Mithal | |

FOREIGN PATENT DOCUMENTS

| | | | |
|---|---|---|---|
| GB | 2311059 | A | 9/1997 |
| WO | WO-2009146433 | A1 | 12/2009 |
| WO | WO-2010071790 | A1 | 6/2010 |
| WO | WO-2014014844 | A1 | 1/2014 |

OTHER PUBLICATIONS

Sundell, Olli, International Search Report, prepared for PCT/GB2016/052925, dated Nov. 7, 2016, three pages.

* cited by examiner

*Primary Examiner* — Jeffrey R Allen
(74) *Attorney, Agent, or Firm* — Winstead PC

(57) ABSTRACT

A lid for a beverage container is provided. The lid comprises a top side (3), an underside (5) and a flange portion (7) for connecting the lid to the container. The lid further comprises at least one drinking aperture (17) which permits liquid to pass through the lid, and at least one baffle (19) which is attached to a perimeter of the at least one drinking aperture and extends downwards from the underside of the lid so as to prevent liquid flow through the aperture from one or more flow directions.

7 Claims, 10 Drawing Sheets

FIG. 3A

LID FOR A BEVERAGE CONTAINER

FIELD OF THE INVENTION

The present invention is directed to the field of beverage containers. More specifically, the present invention is a lid for a beverage container, where the lid and container may be disposable or reusable. The lid is particularly suited, although not exclusively so, for use with disposable beverage containers such as takeaway cups for hot beverages such as coffee and tea.

BACKGROUND OF THE INVENTION

Portable beverage containers are known, where it is desirable to place a removable lid on the container in order to ensure the contents do not spill during transportation and, in the case of hot beverages, to ensure that the contents remain heated for an period of time after the beverage is poured. Flasks and other reusable beverage containers tend to include features such as stoppers or integral straw arrangements in order to contain the beverage and then pour or drink the beverage from the container when desired. Whilst such arrangements may be justified on reusable containers, in relative terms they are overly complicated and costly for use with much cheaper disposable beverage containers such as those used by coffee shops for takeaway coffees and teas for instance.

With these kinds of disposable container it is known to provide a lid formed from a plastics material, where there is an aperture provided in the lid so that the beverage may be drunk whilst the lid remains in place. One disadvantage of such lids is that inadvertent bumping or shaking of the container can lead to the beverage splashing out through the aperture in the lid.

WO2010/071790 discloses a splash-resistant lid for a disposable beverage container where the aperture in the lid is provided with a number of examples of baffle arrangements which are aim at preventing the beverage splashing out of the aperture. However, whilst the baffle arrangements may reduce or prevent splashing, they are complicated to form and would consequently increase the cost of the disposable lid. Furthermore, the baffles proposed would have a detrimental effect on the flow rate of the beverage through the aperture(s) in the lid.

It is an aim of the present invention to provide a splash-resistant lid for a beverage container which obviates or mitigates the aforementioned disadvantages in the prior art.

SUMMARY OF THE INVENTION

According to a first aspect of the present invention, there is provided a lid for a beverage container, the lid comprising a top side, an underside and a flange portion for connecting the lid to the container; wherein the lid further comprises:

at least one drinking aperture which permits liquid to pass through the lid; and at least one baffle which is attached to a perimeter of the at least one drinking aperture and extends downwards from the underside of the lid so as to prevent liquid flow through the aperture from one or more flow directions.

The at least one drinking aperture may have a pair of generally lateral edges and a pair of generally longitudinal edges, and the baffle comprises:

a side wall connected to one of the pair of lateral edges; and a pair of end walls, each end wall connected to a respective one of the longitudinal edges;

wherein the side wall and end walls define a baffle aperture which only permits liquid to enter the drinking aperture from the other of the pair of lateral edges.

The side wall may be concave.

The drinking aperture may lie in a first plane and the baffle aperture may lie in a second plane which lies at an angle of 70-90 degrees relative to a first plane. Most preferably, the second plane lies at an angle of 80-90 degrees relative to the first plane.

The baffle aperture may have substantially the same cross sectional area as the drinking aperture.

The baffle may be formed from a portion of the lid which is partially detached so as to form the at least one drinking aperture, the baffle remaining connected to the lid along at least one edge of the aperture so as to form a flap which can be folded downwards from the underside of the lid.

The at least one drinking aperture may have a pair of generally lateral edges and a pair of generally longitudinal edges, and the baffle is connected to one of the lateral edges only. The longitudinal edges may be shorter than the lateral edges such that the at least one aperture has a generally rectangular shape.

The baffle may lie at an angle of 30-60 degrees relative to the underside of the lid.

The top side of the lid may include a recess and the at least one drinking aperture is located in the recess.

The top side of the lid may include a recess and an outer rim portion, and wherein the at least one drinking aperture is located in the outer rim portion adjacent the recess.

BRIEF DESCRIPTION OF THE DRAWINGS

Preferred embodiments of the present invention will now be described, by way of example only, with reference to the following drawings.

DETAILED DESCRIPTION OF THE DRAWINGS

Figure 1:
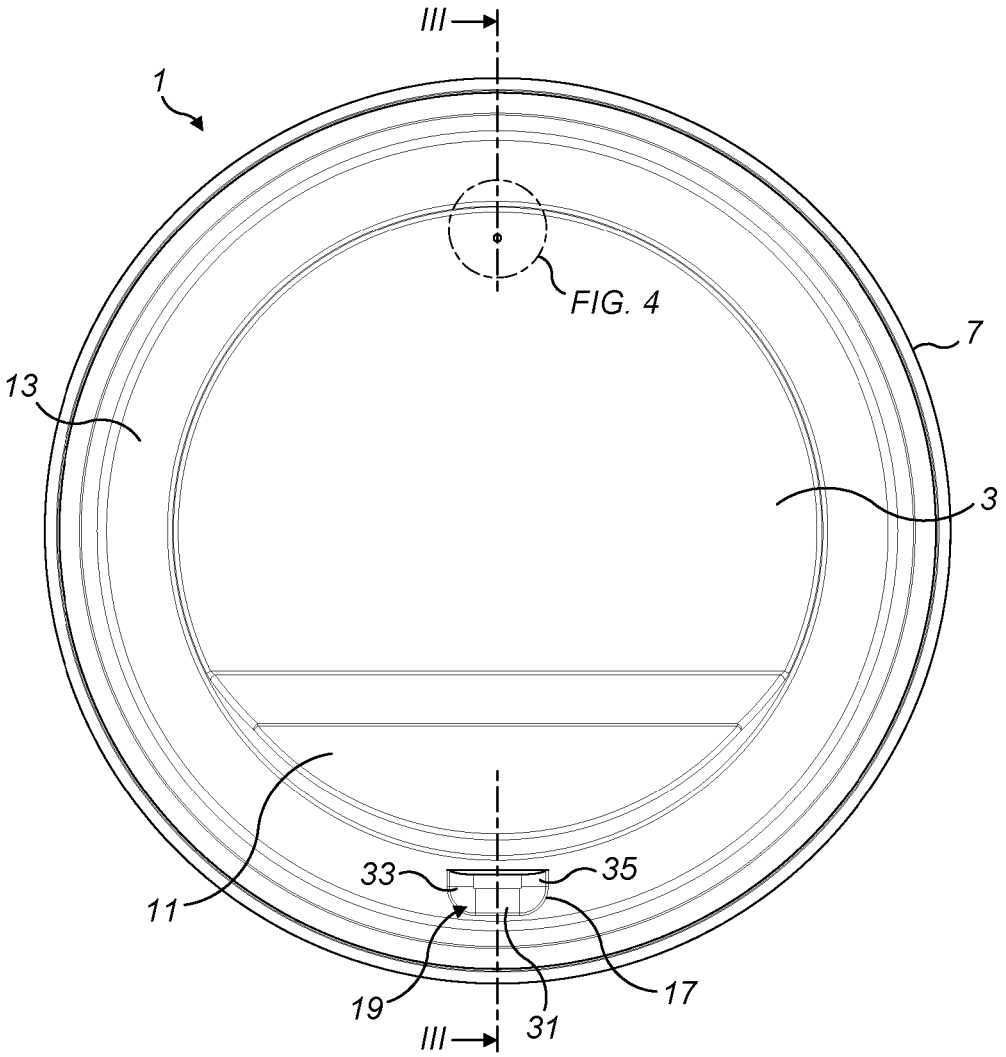
FIG. 1 is a plan view of a first embodiment of a lid for a beverage container.
Figure 2:
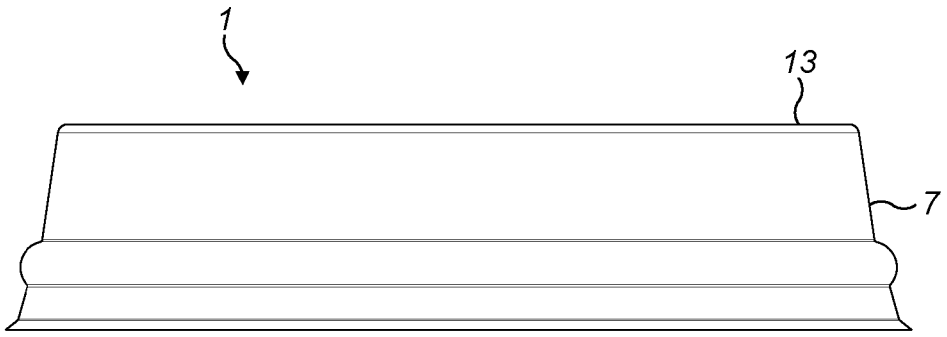
FIG. 2 is a side view of the lid shown in FIG. 1.

A first embodiment of a lid for a beverage container in accordance with the present invention is shown in FIGS. 1-6. This illustrated embodiment of the lid is preferably formed from a plastics material, is intended to be disposable and used in conjunction with a disposable paper or card cup (not shown) for a hot beverage such as coffee or tea. However, it should be understood that neither this embodiment nor any of the other embodiments of the invention described herein are limited to this specific application. Instead, the lid may be reusable and/or formed from other materials such as paper, foam or a relatively rigid plastics material and used in conjunction with a reusable beverage container which itself may be formed from a relatively rigid plastics material or a metal, for example.

The lid of the first embodiment is generally designated 1 in FIGS. 1-6. The lid comprises a top side 3, an underside 5 and a flange portion 7 for connecting the lid to the beverage container. This connection is achieved by providing an internal groove 9 which extends around the internal surface of the flange portion 7, where the groove is sized so as to receive an upper lip of the container in an interference fit. With the lid 1 connected to the container the liquid within the container is retained and, in the case of hot beverages and other liquids, also kept warm for a prolonged period of time.

The top side and underside of the lid may be substantially planar or, as is the case with the first embodiment shown in FIGS. 1-6, the top side 3 may include a recess or recessed portion 11 and an outer rim portion 13 whose upper surface lies above that of the top side. The top side 3 may also include a ventilation aperture 15 which aids liquid flow out through the lid 1 by allowing air to enter the container. At least one drinking aperture 17 which permits the liquid contents of the container to pass through the lid 1 is provided. The aperture 17 is located in the outer rim portion 13 adjacent the recess 11 in this embodiment, with the recess making it easier for a user to position their mouth in the ideal drinking position on the lid 1. More specifically, the recess 11 in the lid 1 allows the user to drink from the container in the same manner as they would from a cup or mug. Consequently, the user can avoid tongue burning from having hot liquid poured directly into the mouth. The recess 11 also allows liquid captured therein, whether from spillage or drinking, to drain back into the container.

Figure 3:
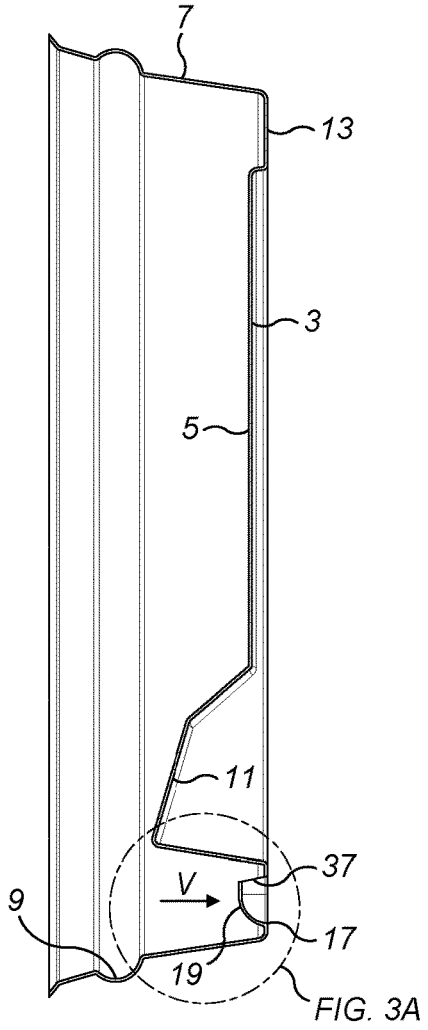
FIG. 3 is a sectional view of the lid along the line III-III shown in FIG. 1.
Figure 6:
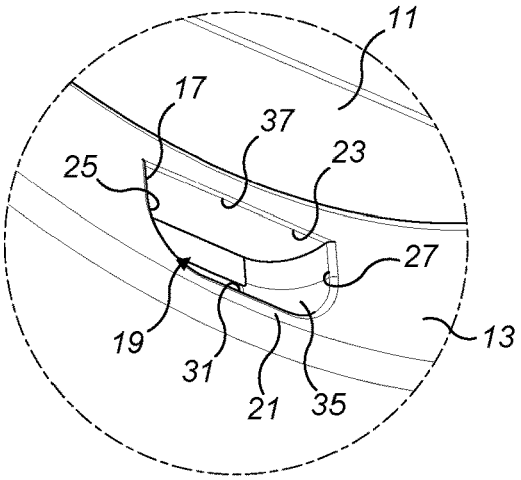
FIG. 6 is a detail view of the lid as shown in FIG. 5.

The drinking aperture 17 is seen best in FIGS. 1, 3 and 6. The lid 1 includes a baffle 19 which is attached to the perimeter of the drinking aperture 17 and extends downwards from the underside 5 of the lid. As seen best in FIG. 1, the baffle 19 is positioned so that the drinking aperture 17 is blocked to liquid flow from one or more directions. In other words, the baffle 19 does not allow liquid to flow through the aperture 17 from one or more directions. As shown in FIGS. 1 and 3, in this particular embodiment the baffle 19 is blocking flow in a generally vertical (when the lid is attached to an upright container) direction, with this flow direction represented by the arrow V in FIG. 3. This is further illustrated in FIG. 1, where only the baffle 19 is visible when viewing the drinking aperture 17 from directly above.

Referring to FIG. 6, the drinking aperture 17 has a pair of lateral edges 21,23 and a pair of generally longitudinal edges 25,27. "Lateral" refers to the direction which is generally transverse to the direction assumed by a person drinking from the aperture 17, whereas "longitudinal" refers to the direction generally parallel to that assumed by the drinker. It should also be noted that the references to lateral and longitudinal do not limit the edges of the aperture 17 to being substantially straight. As shown in FIGS. 1 and 6 in particular, one or more of the lateral and/or longitudinal edges may have a curved component.

The baffle 19 has a side wall 31 which is connected to a proximal lateral edge 21 of the aperture 17, and a pair of end walls 33,35 which are each connected to a respective longitudinal edge 25,27 of the aperture. Between them these baffle walls 31,33,35 define a baffle aperture 37 which only permits liquid to enter the drinking aperture 17 from its distal lateral edge 23. Connecting the baffle 19 to the proximal lateral edge alone means that any liquid agitated in a sloshing motion due to a side-to-side movement of the container will be prevented by the baffle from travelling up through the aperture 17.

In this preferred embodiment the baffle walls 31,33,35 are concave, but they may alternatively be planar. For example, the side wall 31 may lie at an angle (e.g. 30-60 degrees) relative to the underside 5 of the lid, whilst the end walls 33,35 are substantially vertical. The baffle 19 can be formed during the production process for the lid itself. For example, where the lid is formed from a moulded plastics material the baffle can be moulded as part of the lid. The baffle aperture 37 can then be cut or punched out and the lid is then ready for use.

Figure 3A:
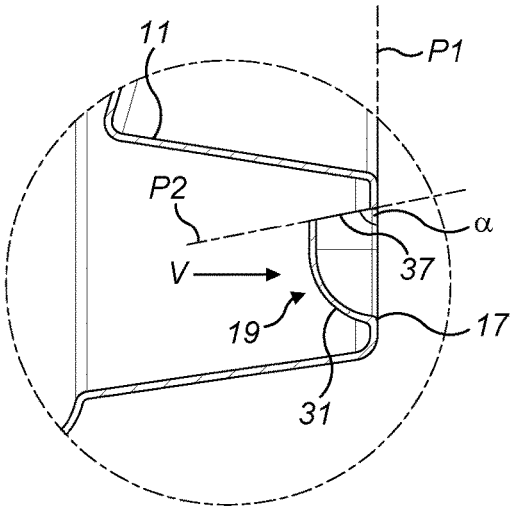
FIG. 3A is a detail view of an element of the lid shown in FIG. 3.
Figure 4:
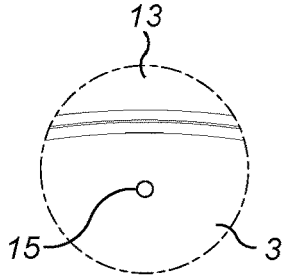
FIG. 4 is a detail view of an element of the lid shown in FIG. 1.
Figure 5:
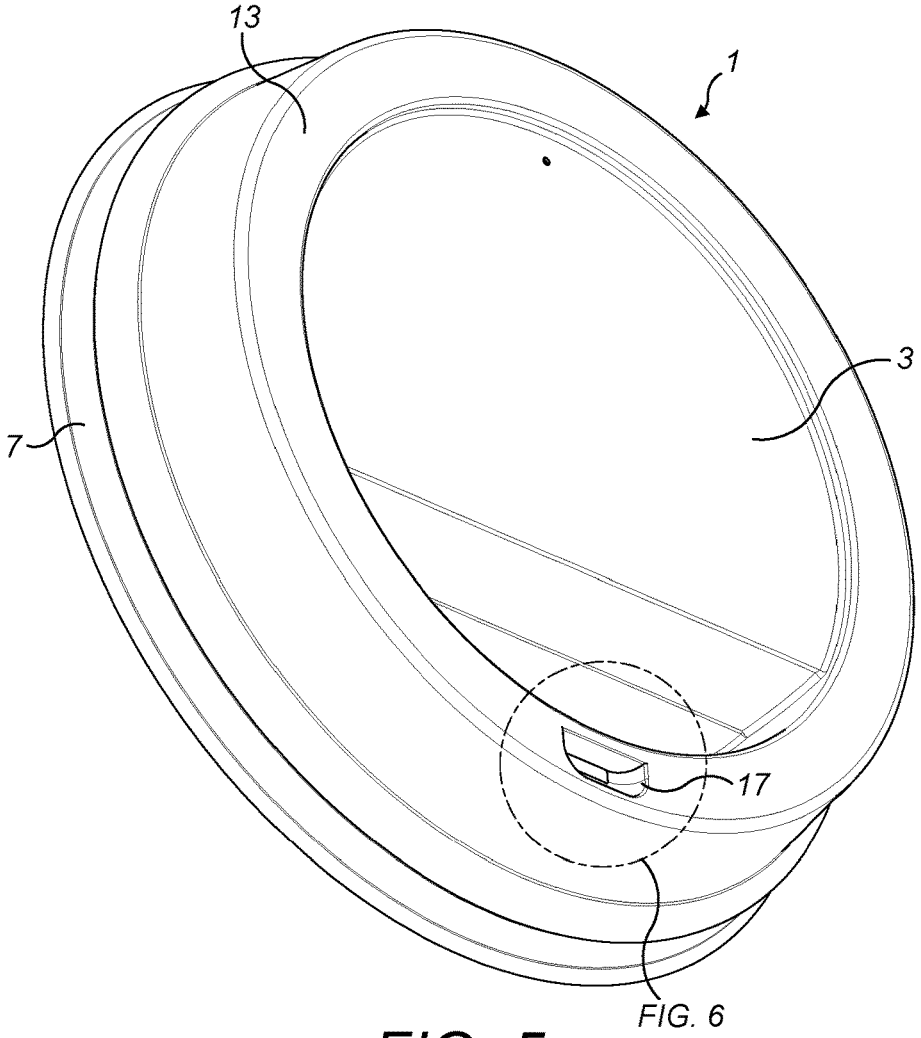
FIG. 5 is a perspective view of the lid shown in FIG. 1.

As best seen in FIG. 3A, the drinking aperture 17 lies in a first plane P1 and the baffle aperture 37 lies in a second plane P2 which is at an angle $\alpha$ relative to the first plane P1. The angle $\alpha$ may be substantially 90 degrees, or else may be between 70 and 90 degrees. Most preferably, the angle $\alpha$ may be between 80 and 90 degrees. The baffle aperture 37 may have substantially the same cross sectional area as that of the drinking aperture 17.

In use, the positioning of the baffle 19 means that liquid cannot exit the drinking aperture 17 from directly below the aperture as represented by the flow direction arrow V in FIGS. 3 and 3A. This means that spill and splash of the liquid through the aperture is greatly reduced when the beverage container is jolted up and down. Similarly with the baffle walls 31,33,35 attached to, and extending downwards from, three edges 21,25,27 of the drinking aperture the baffle 19 also prevents liquid flow into the aperture from those edges 21,25,27. Again, this greatly reduces spill and splash of liquid through the aperture 17 when the container is shaken or jolted in a side-to-side motion. However, the relative orientation of the planes P1,P2 in which the drinking and baffle apertures 17,37 lie, and the comparative cross sectional areas of the two apertures mean that the flow of liquid through the aperture during drinking is not compromised to any significant degree.

A second embodiment of a lid for a beverage container in accordance with the present invention is shown in FIGS. 7-14. The lid of the second embodiment is generally designated 101 and comprises a top side 103, an underside 105 and a flange portion 107 for connecting the lid to a beverage container. This connection is achieved by providing an internal groove 109 which extends around the internal surface of the flange portion 107, where the groove is sized so as to receive an upper lip of the container in an interference fit.

As was the case with the first embodiment shown in FIGS. 1-6, the top side 103 includes a recess or recessed portion 111 and an outer rim portion 113 whose upper surface lies above that of the top side. The top side 103 may also include a ventilation aperture 115. Three drinking apertures 117 which permit the liquid contents of the container to pass through the lid 101 is provided. The apertures 117 are located in the recess 111 adjacent the outer rim 113 in this embodiment. As in the first embodiment the recess 111 makes it easier for a user to position their mouth in the ideal drinking position on the lid 101.

Figure 7:
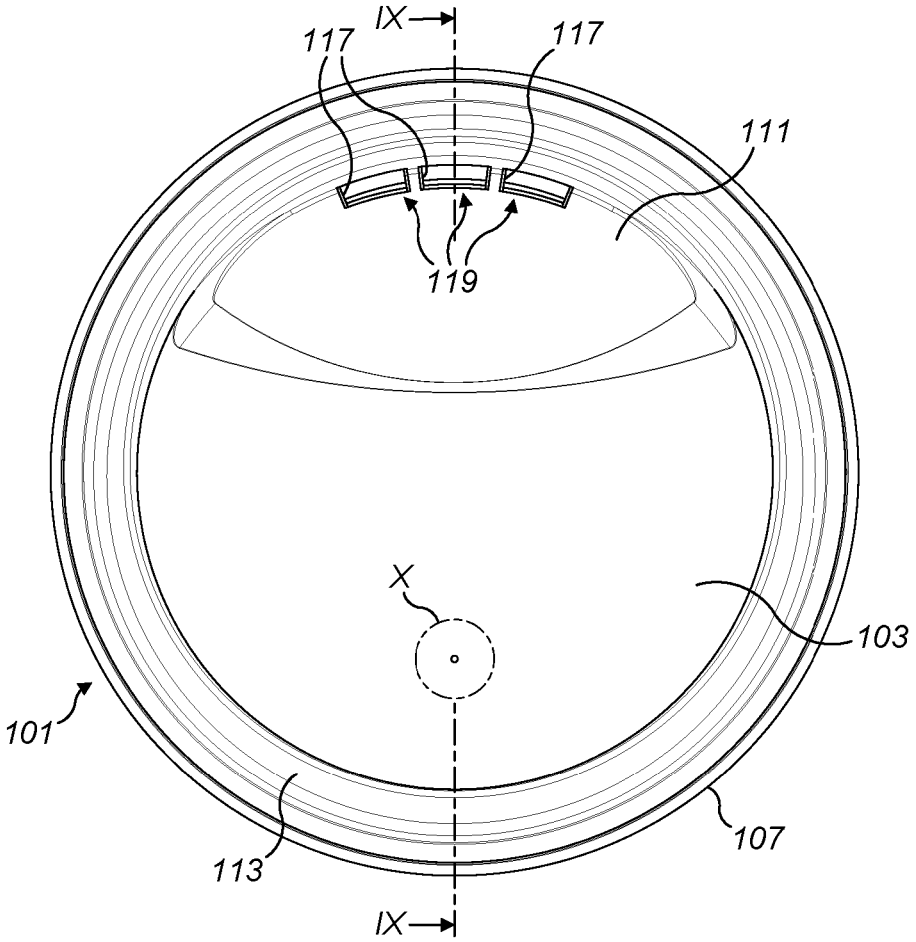
FIG. 7 is a plan view of a second embodiment of a lid for a beverage container.
Figure 8:
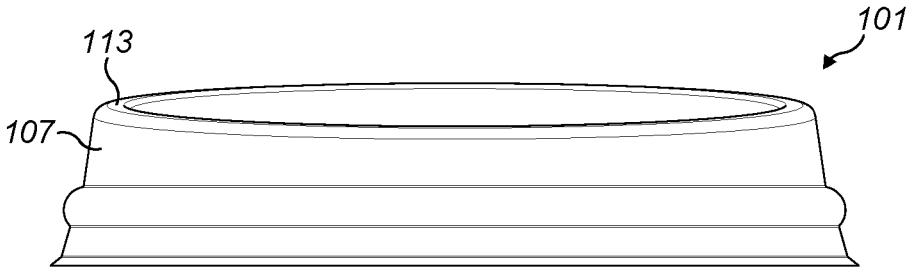
FIG. 8 is a side view of the lid shown in FIG. 7.
Figure 9:
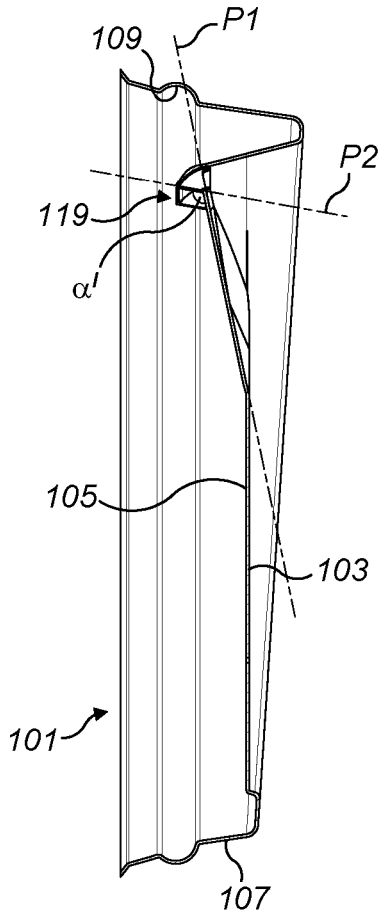
FIG. 9 is a sectional view of the lid along the line IX-IX shown in FIG. 7.
Figure 10:
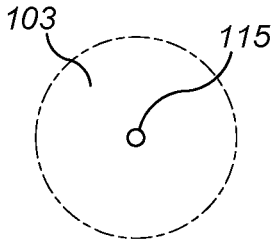
FIG. 10 is a detail view of an element of the lid shown in FIG. 7.
Figure 11:
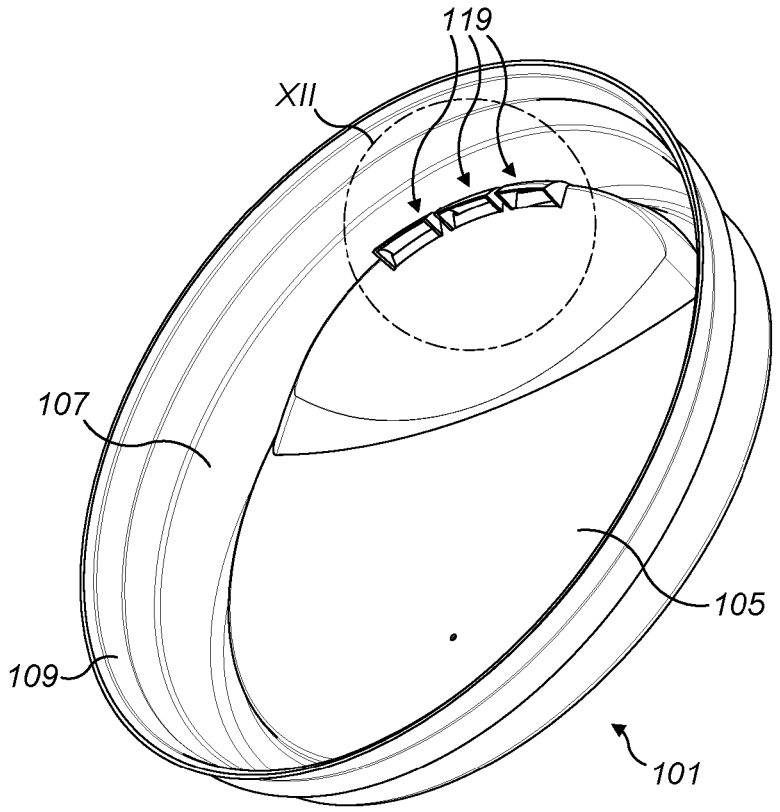
FIG. 11 is a perspective view showing an underside of the lid shown in FIG. 7.
Figure 12:
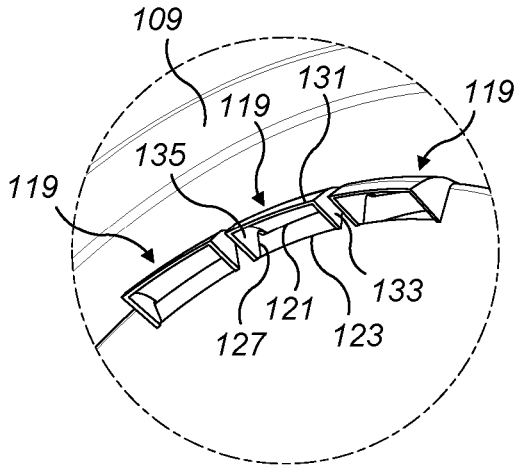
FIG. 12 is a detail view of the lid as shown in FIG. 11.
Figure 13:
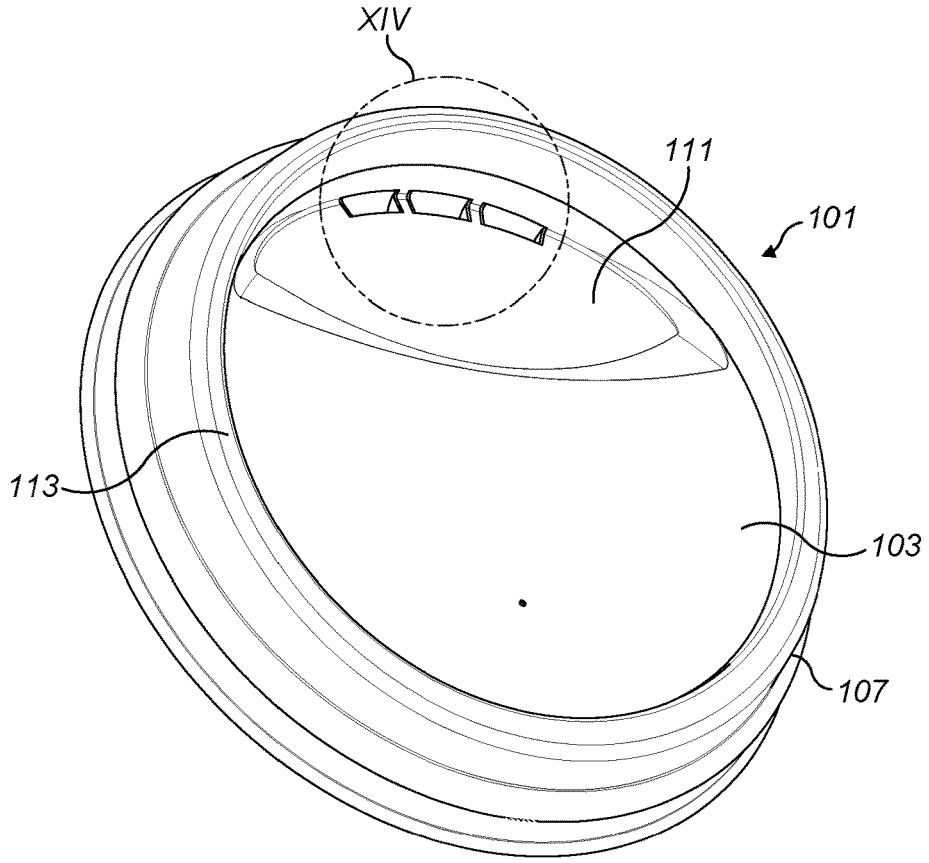
FIG. 13 is a perspective view showing a top side of the lid shown in FIG. 7.
Figure 14:
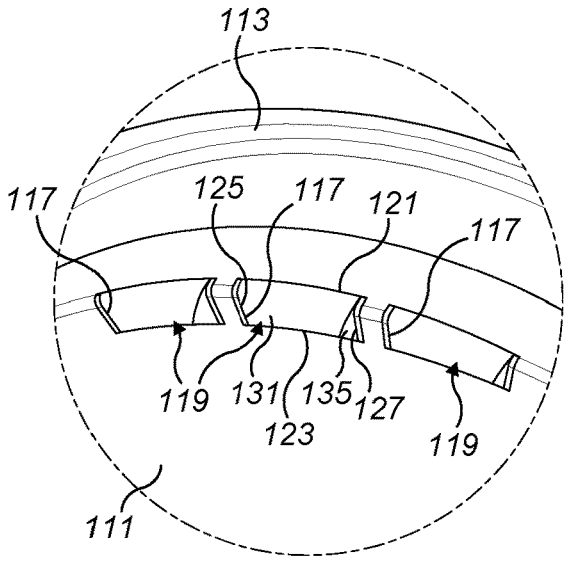
FIG. 14 is a detail view of the lid as shown in FIG. 13.
Figure 15:
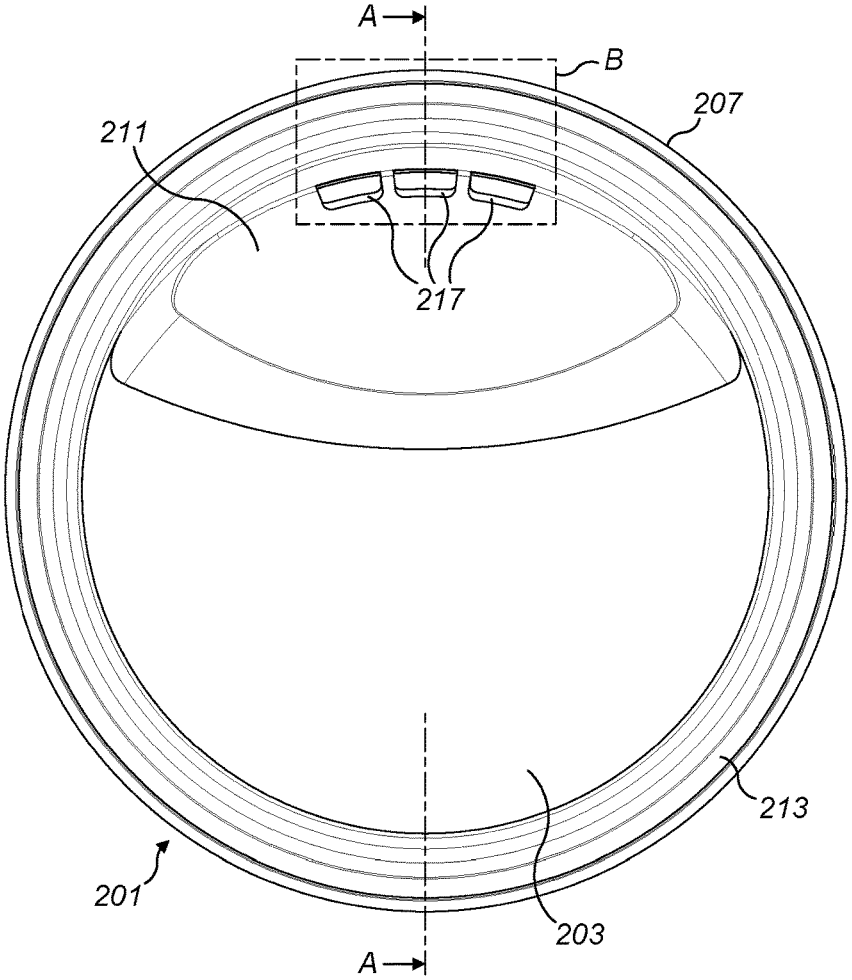
FIG. 15 is a plan view of a third embodiment of a lid for a beverage container.
Figure 16:
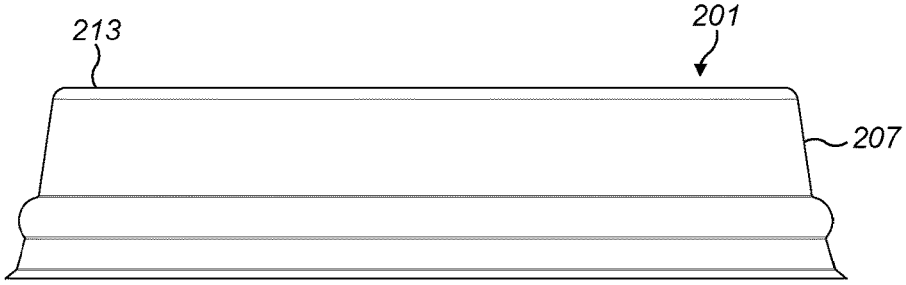
FIG. 16 is a side view of the lid shown in FIG. 15.
Figure 17:
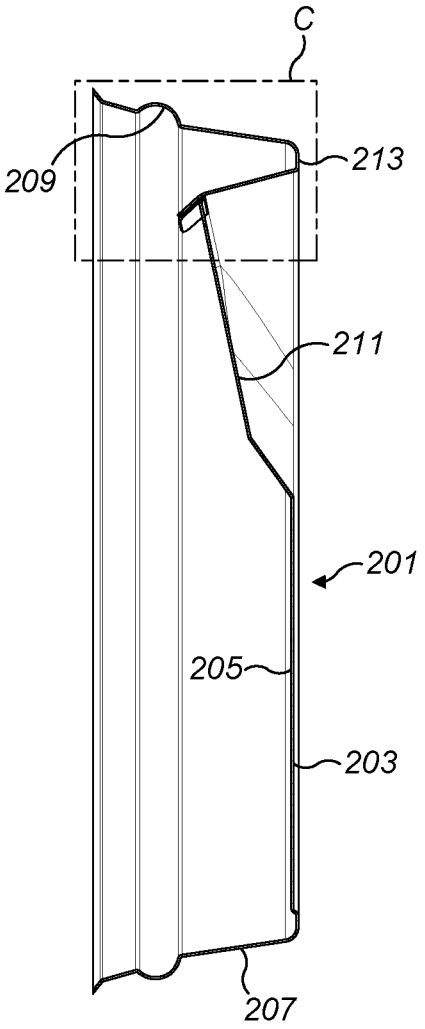
FIG. 17 is a sectional view of the lid along the line A-A shown in FIG. 15.

The drinking apertures 117 are seen best in FIGS. 9, 12 and 14. The lid 101 includes three baffles 119, each of which is attached to the perimeter of a respective drinking aperture 117 and extends downwards from the underside 105 of the lid. As seen best in FIG. 7, the baffles 119 are positioned so that the drinking apertures 117 are blocked to liquid flow from one or more directions. In other words, the baffles 119 do not allow liquid to flow through the apertures 117 from one or more directions. As shown in FIGS. 7 and 9, the baffles 119 are blocking flow in a generally vertical (when the lid is attached to an upright container) direction, with this flow direction represented by the arrow V in FIG. 9. This is further illustrated in FIG. 7, where only the baffles 119 are visible when viewing the drinking apertures 117 from directly above.

The arrangement of the drinking apertures 117 and baffles will now be described in more detail with particular reference to FIGS. 12 and 14. To maintain the clarity of the illustrations only the central aperture/baffle arrangement is labelled in these figures, but it should be understood that the description relating thereto applies to all three of the aperture/baffle arrangements provided on the lid 101. Each drinking aperture 117 has a pair of lateral edges 121,123 and a pair of generally longitudinal edges 125,127. The references to "lateral" and "longitudinal" are to be interpreted in the same manner as was explained above regarding the first embodiment. In this second embodiment, it is the lateral edges 121,123 which have a degree of curvature as the apertures 117 follow the curve of the generally circular lid 101, but each aperture 117 is generally rectangular in shape.

Each baffle 119 has a side wall 131 which is connected to a proximal lateral edge 121 of its respective aperture 117, and a pair of end walls 133,135 which are each connected to a respective longitudinal edge 125,127 of that aperture. Between them these baffle walls 131,133,135 define a baffle aperture 137 which only permits liquid to enter the drinking aperture 117 from its distal lateral edge 123. In this preferred embodiment the baffle side wall 131 is concave, but the end walls 133,135 are planar and substantially vertical. Alternatively, the side wall 131 may be planar and lie at an angle (e.g. 30-60 degrees) relative to the underside 105 of the lid. In a further alternative, all of the baffle walls 131,133,135 may be concave or curved in a similar manner to those of the first embodiment. The baffles 119 may be formed in the same manner as described above in relation to the first embodiment.

As shown FIG. 9, each drinking aperture 117 lies in a first plane P1 defined by the surface of the recess 111 and each respective baffle aperture 137 lies in a second plane P2 which is at an angle $\alpha'$ relative to the first plane P1. The angle $\alpha'$ may be substantially 90 degrees, or else may be between 90 and 110 degrees. The baffle apertures 137 may have substantially the same cross sectional area as that of their respective drinking apertures 117.

In use, the positioning of the baffles 119 means that liquid cannot exit the drinking apertures 117 from directly below the aperture as represented by the flow direction arrow V in FIG. 9. This means that spill and splash of the liquid through the aperture is greatly reduced when the beverage container is jolted up and down. Similarly with the baffle walls 131,133,135 attached to, and extending downwards from, three edges 121,125,127 of each drinking aperture 117 the baffles 119 also prevent liquid flow into the apertures 117 from those edges 121,125,127. Again, this greatly reduces spill and splash of liquid through the apertures 117 when the container is shaken or jolted in a side-to-side motion. However, the provision of three drinking apertures 117, the relative orientation of the planes P1,P2 in which the drinking and baffle apertures 117,137 lie, and the comparative cross sectional areas of the two apertures mean that the flow of liquid through the aperture during drinking is not compromised to any significant degree.

A third embodiment of a lid for a beverage container in accordance with the present invention is shown in FIGS. 15-21. The lid of the third embodiment is generally designated 201 and comprises a top side 203, an underside 205 and a flange portion 207 for connecting the lid to a beverage container. This connection is achieved by providing an internal groove 209 which extends around the internal surface of the flange portion 207, where the groove is sized so as to receive an upper lip of the container in an interference fit.

The top side of the lid of the third embodiment may be substantially flat or planar, but as with the preceding embodiments the top side 203 includes a recess or recessed portion 211 and an outer rim portion 213 whose upper surface lies above that of the top side. The top side 203 may also include a ventilation aperture (not shown). The lid 201 comprises at least one drinking aperture which permits liquid to pass through the lid. Preferably, as shown, the lid 201 comprises three drinking apertures 217 which are located in the recess 211 adjacent the outer rim 213.

Figure 18:
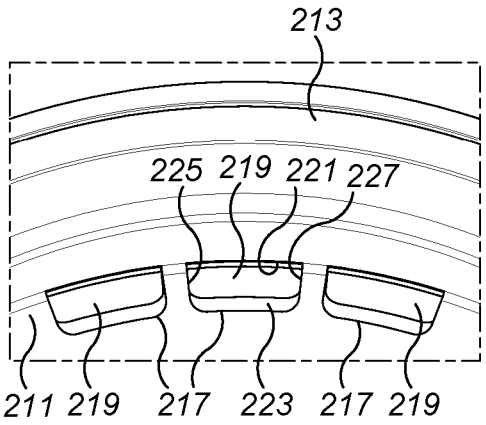
FIG. 18 is a detail view of the area marked "B" in the lid shown in FIG. 15.
Figure 19:
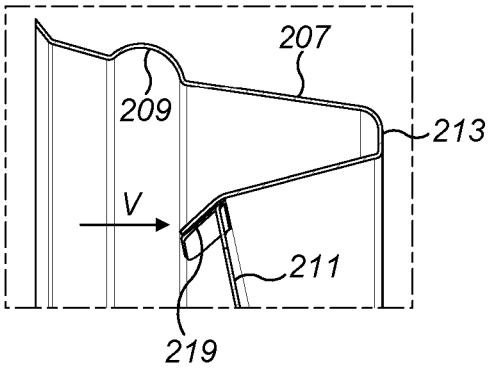
FIG. 19 is a detail view of the area marked "C" in the lid shown in FIG. 17.
Figure 21:
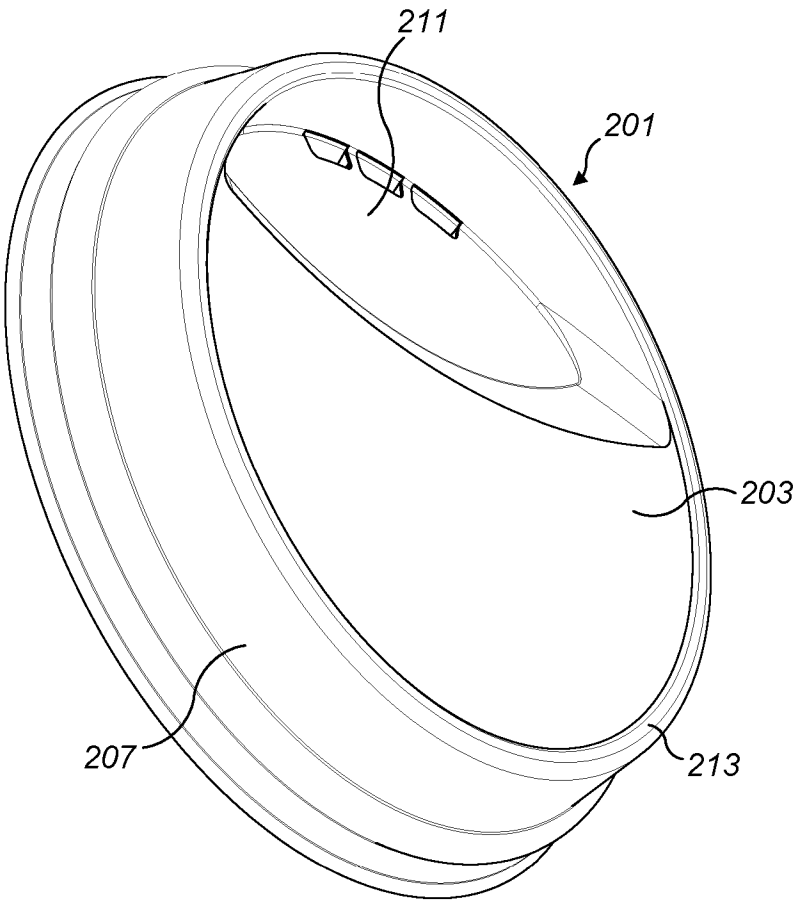
FIG. 21 is a perspective view showing a top side of the lid shown in FIG. 15.
Figure 20:
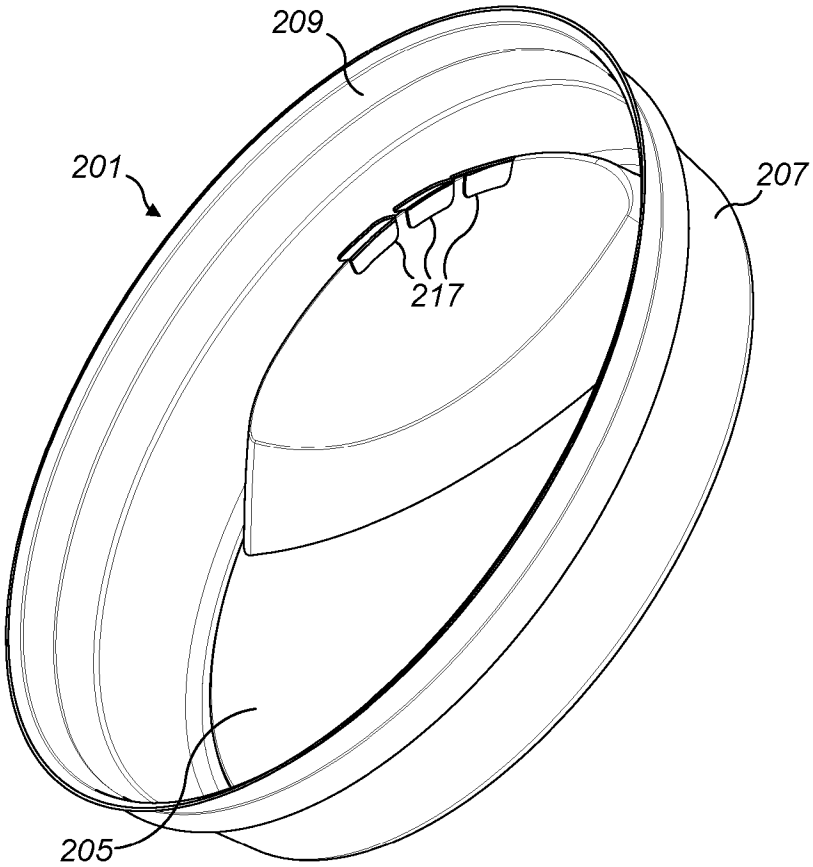
FIG. 20 is a perspective view showing an underside of the lid shown in FIG. 15.

The drinking apertures 217 are seen best in FIGS. 18 and 19. The lid 201 includes three baffles 219, each of which is attached to the perimeter of a respective drinking aperture 217 and extends downwards from the underside 205 of the lid. As seen best in FIG. 19, the baffles 219 are positioned so that the drinking apertures 217 are blocked to liquid flow from one or more directions. In other words, the baffles 219 do not allow liquid to flow through the apertures 217 from one or more directions. The baffles 219 are blocking flow in a generally vertical (when the lid is attached to an upright container) direction, with this flow direction represented by the arrow V in FIG. 19. This is further illustrated in FIG. 18, where the baffles 219 are blocking all but a small area of the drinking apertures 217 when viewed from directly above.

The arrangement of the drinking apertures 217 and baffles 219 will now be described in more detail. Each baffle 219 is formed from a portion of the lid 201 (in this example, the recess 211 specifically) which is partially detached from the remainder so as to form the at least one drinking aperture 217. This partial detachment may be achieved by punching or cutting the lid where the apertures 217 are to be formed, for example. In doing so, the baffle 219 remains connected to the lid 201 along at least one edge of the aperture 217 so as to form a flap which can be folded downwards from the underside 205 of the lid 201.

To maintain the clarity of the illustrations only the central aperture/baffle arrangement is labelled in FIG. 18, but it should be understood that the description below relating thereto applies to all three of the aperture/baffle arrangements provided on the lid 201. Each drinking aperture 217 has a pair of lateral edges 221,223 and a pair of generally longitudinal edges 225,227, with the former being longer than the latter. The references to "lateral" and "longitudinal" are once again to be interpreted in the same manner as with explained above regarding the first embodiment. In this third embodiment, the drinking apertures 217 each have a generally rectangular shape but one of the lateral and/or longitudinal edges may have a degree of curvature. Each of the three baffles 219 is connected to the proximal (i.e. that closest to the outer rim of the lid) lateral edge 221 only, such that there is effectively a hinge created between the lateral edge 221 and the baffle 219 when the latter is folded downwards. The baffle 219 may be folded downwards such that it lies at an angle of 30-60 degrees relative to the top surface of the outer rim portion, or the recess, depending upon where the apertures 217 are formed.

In use, the baffles 219 mean that liquid cannot exit the drinking apertures 217 from directly below the aperture as represented by the flow direction arrow V in FIG. 19. This means that spill and splash of the liquid through the aperture is greatly reduced when the beverage container is jolted up and down, and is also reduced when the container is shaken or jolted in a side-to-side motion although not to the same degree as the preceding embodiments. Additionally, with the provision of three drinking apertures 217, and the angle of the baffles 219 relative to the top surface of the portion of the lid in which they are formed, the flow of liquid through the aperture during drinking is not compromised to any significant degree.

The present invention provides a lid for a beverage container which significantly reduces the amount of splashing and spilling of liquid out of the lid if the container is inadvertently jolted or shaken, whether that is primarily in the horizontal or vertical directions. At the same time, the manner in which the baffles are formed and operate means that the lid is relatively simple and economical to produce, and also does not affect the flow rate of liquid out through the drinking aperture(s) to a significant extent.

Modifications and improvements may be incorporated without departing from the scope of the invention.

The invention claimed is:

1. A lid for a beverage container, the lid comprising:
- a top side;
- an underside;
- a flange portion for connecting the lid to the beverage container;
- at least one drinking aperture including a pair of generally lateral edges and a pair of generally longitudinal edges, which permits liquid to pass through the lid; and
- at least one baffle attached to a perimeter of the at least one drinking aperture and extending downwards from the underside of the lid so as to prevent liquid flow through the aperture from one or more flow directions, the at least one baffle comprising:
  - a side wall connected to one of the generally lateral edges in the pair of generally lateral edges; and
  - a pair of end walls, each end wall connected to a respective one of the generally longitudinal edges;
- wherein the other generally lateral edge in the pair of generally lateral edges is configured such that neither a side wall nor an end wall is connected thereto;
- wherein the side wall and the pair of end walls define a baffle aperture which only permits liquid to enter the drinking aperture from the other generally lateral edge in the pair of generally lateral edges.

2. The lid of claim 1, wherein the side wall is concave.

3. The lid of claim 1, wherein the drinking aperture lies in a first plane and the baffle aperture lies in a second plane which lies at an angle of 70-90 degrees relative to the first plane.

4. The lid of claim 1, wherein the baffle aperture has substantially the same cross sectional area as the drinking aperture.

5. The lid of claim 1, wherein the top side of the lid includes a recess and the at least one drinking aperture is located in the recess.

6. The lid of claim 1, wherein:
- the top side of the lid includes a recess and an outer rim portion; and
- the at least one drinking aperture is located in the outer rim portion adjacent the recess.

7. The lid of claim 2, wherein the each of the end walls of the baffle are concave.

* * * * *